US011027409B2

(12) United States Patent
Macor

(10) Patent No.: US 11,027,409 B2
(45) Date of Patent: Jun. 8, 2021

(54) WRENCH HANDLE AND WRENCH

(71) Applicant: Richard J. Macor, Easton, PA (US)

(72) Inventor: Richard J. Macor, Easton, PA (US)

(73) Assignee: Proprietary Technologies, Inc.

( * ) Notice: Subject to any disclaimer, the term of this patent is extended or adjusted under 35 U.S.C. 154(b) by 368 days.

(21) Appl. No.: 16/350,804

(22) Filed: Jan. 14, 2019

(65) Prior Publication Data

US 2020/0223054 A1 Jul. 16, 2020

(51) Int. Cl.

| | |
|---|---|
| ***B25G 1/08*** | (2006.01) |
| ***B25B 23/00*** | (2006.01) |
| ***B25B 23/16*** | (2006.01) |
| ***B25B 13/46*** | (2006.01) |

(52) U.S. Cl.
CPC ..... *B25G 1/085* (2013.01); *B25B 13/461* (2013.01); *B25B 23/0007* (2013.01); *B25B 23/16* (2013.01)

(58) Field of Classification Search
CPC ..... B25G 1/002; B25G 1/005; B25G 1/04; B25G 1/043; B25G 1/08; B25G 1/085; B25B 23/0007; B25B 23/0021; B25B 23/0035; B25B 23/16; B25B 13/461
See application file for complete search history.

(56) References Cited

U.S. PATENT DOCUMENTS

| | | | | |
|---|---|---|---|---|
| 5,148,724 | A | 9/1992 | Rexford | |
| 5,943,924 | A * | 8/1999 | Jarvis | B25G 1/043 81/177.2 |
| 6,324,947 | B2 * | 12/2001 | Jarvis | B25B 23/0021 81/177.2 |
| 6,336,382 | B2 * | 1/2002 | Cerda | B25B 13/461 81/177.1 |
| 6,883,402 | B2 * | 4/2005 | Cerda | B25B 13/461 81/177.1 |
| 7,044,028 | B1 * | 5/2006 | Lozano | B25B 13/461 81/177.1 |
| 7,421,931 | B2 | 9/2008 | Hu | |
| D778,698 | S | 2/2017 | Huang | |
| 10,040,188 | B2 | 8/2018 | Huang | |

* cited by examiner

*Primary Examiner* — David B. Thomas

(57) ABSTRACT

An example embodiment of the present invention is a wrench handle that is elongated in a predetermined direction. At least a portion of the wrench handle is hollow. The hollow portion has a front part and a rear part. The hollow portion is also configured to substantially house and detachably secure a socket extension bar therein.

18 Claims, 3 Drawing Sheets

WRENCH HANDLE AND WRENCH

FIELD OF THE INVENTION

The present invention relates to wrench handles and wrenches including ratchet wrenches that can be used with a variety of different sockets and/or socket extension bars.

BACKGROUND OF THE INVENTION

Wrenches, ratchet wrenches, sockets, and socket extension bars have been around for many years. Typically, a user will use a socket extension bar with a ratchet wrench to improve accessibility to a work-piece such as a nut or bolt and/or to provide additional user knuckle clearance. A user will search for, find and attach a socket extension bar to a ratchet wrench when wanted but often the desired socket extension bar is not handy. Accordingly, the inventor herein contemplates detachably securing a socket extension bar to a ratchet wrench so that the socket extension bar is always handy for use with the ratchet wrench.

SUMMARY OF THE INVENTION

An example embodiment of the present invention is a wrench handle that is elongated in a predetermined direction. At least a portion of the wrench handle is hollow. The hollow portion has a front part and a rear part. The hollow portion is also configured to substantially house and detachably secure a socket extension bar therein.

It is an objective of the present invention described herein that it provides convenience to wrench users by substantially housing and detachably securing a socket extension bar within the handle of a wrench, particularly ratchet wrenches.

It is another objective of the present invention described herein that the socket extension bar is substantially housed and secured within the wrench handle without compromising existing wrench features including ergonomics, size, swing-arc clearance, etc.

It is another objective of the present invention that the socket extension bar is attachable to and detachable from a wrench in a simple labor-efficient way.

And, it is another objective of the present invention that it is commercially viable, simple in design, and cost-efficient to manufacture.

BRIEF DESCRIPTION OF THE DRAWINGS

The present invention is more fully understood when the specification herein is taken in conjunction with the drawings appended hereto, wherein.

DETAILED DESCRIPTION OF THE DRAWINGS

The various drawings provided herein are for the purpose of illustrating examples of the present invention and not for the purpose of limiting same. Therefore, the drawings herein represent only a few of the many possible examples, embodiments, variations and/or applications of the present invention.

Figure 1:
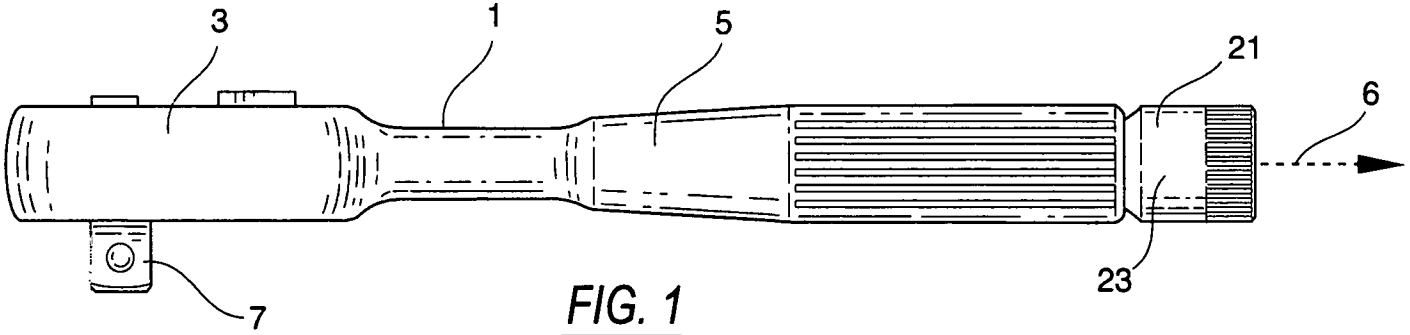
FIG. 1 shows a left side elevation view of a present invention ratchet wrench and socket extension bar.
Figure 2:
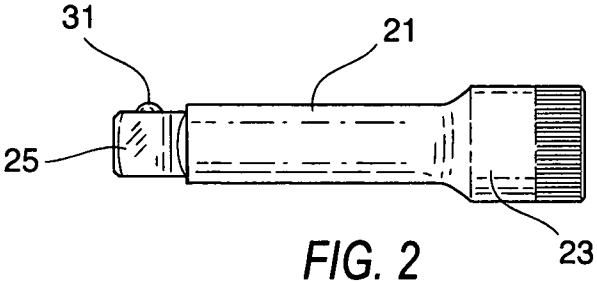
FIG. 2 shows a left side elevation view of the socket extension bar shown in FIG. 1, but removed from the ratchet wrench.
Figure 3:
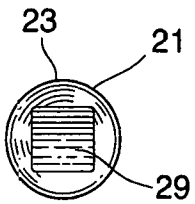
FIG. 3 shows a rear elevation view of the socket extension bar shown in FIGS. 1, 2 and 4.
Figure 4:
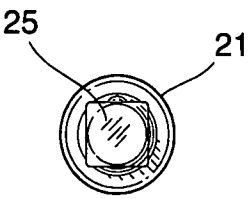
FIG. 4 shows a front elevation view of the socket extension bar shown in FIGS. 1, 2 and 3.
Figure 5:
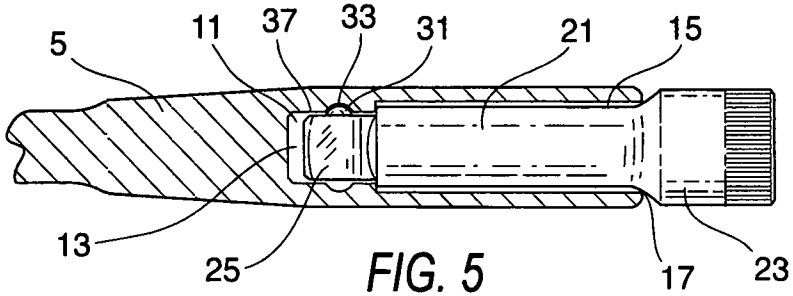
FIG. 5 shows a cut cross-sectional view of the handle of the present invention ratchet wrench shown in FIG. 1.
Figure 6:
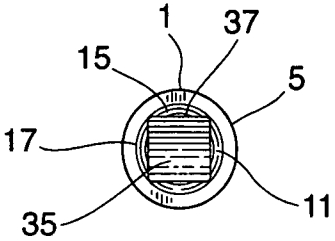
FIG. 6 shows a rear end-view of the handle of the present invention ratchet wrench shown in FIGS. 1 and 5.

FIG. 1 shows a left side elevation view of a present invention ratchet wrench and socket extension bar; FIG. 2 shows a left side elevation view of the socket extension bar shown in FIG. 1, but removed from the ratchet wrench; FIG. 3 shows a rear elevation view of the socket extension bar shown in FIGS. 1, 2 and 4; FIG. 4 shows a front elevation view of the socket extension bar shown in FIGS. 1, 2 and 3; FIG. 5 shows a cut cross-sectional view of the handle of the present invention ratchet wrench shown in FIG. 1; and, FIG. 6 shows a rear end-view of the handle of the present invention ratchet wrench shown in FIGS. 1 and 5 with the socket extension bar removed.

Referring now to FIGS. 1, 2, 3, 4, 5, and 6 together, ratchet wrench 1 has a wrench head 3 and a handle 5. Wrench 1 has a ratcheting mechanism (not seen in this view) inside wrench head 3 and a driving member 7 formed with a predetermined configuration. Wrench handle 5 is elongated in a predetermined direction 6 as shown and has at least a portion thereof that's substantially hollow which is best seen in FIG. 5. Hollow portion 11 has a front part 13 and a rear part 15. The rear part 15 has a distal open end 17.

Elongated socket extension bar 21 has a head 23 at one end and a driving member 25 at the other end thereof. The head 23 has a cavity 29 formed therein with a predetermined configuration which is square shaped in this embodiment as shown in FIG. 3. The driving member 25 of socket extension bar 21 is formed with a predetermined configuration and square shaped in this embodiment as shown in FIG. 4. Socket extension bar 21 has predetermined length and width dimensions.

Hollow portion 11 of ratchet wrench handle 5 is also configured with predetermined length and width dimensions, whereby, socket extension bar 21 may be substantially housed and detachably secured within the hollow portion 11 of wrench handle 5 as shown in FIGS. 1 and 5. This is best seen in FIG. 5. Accordingly, if the objective of one embodiment of the present invention is to house and detachably secure a socket extension bar entirely within the hollow portion of the wrench handle as shown in FIG. 9, then, the length and width dimensions of each of the socket extension bar and the hollow portion of the wrench handle must be predetermined to achieve that structural objective. If the objective of another present invention embodiment is to house and detachably secure a socket extension bar with at least a small portion of the socket extension bar exposed from the rear distal open end of the hollow portion of the wrench handle as shown in FIGS. 1, 5, 7, 8 and 10 for example, then, the length and width dimensions of each of the socket extension bar and the hollow portion of the wrench handle must also be predetermined to accomplish that structural objective. Note that the present invention includes preferred embodiments wherein at least a small portion of the socket extension bar is exposed outside of the hollow portion of the wrench handle while the socket extension bar is substantially housed and detachably secured therein. This structural arrangement facilitates insertion and removal of the socket extension bar into and out of the hollow portion of the wrench handle by a user. In some of these preferred embodiments of the present invention, just the head of the socket extension bar is substantially exposed as shown in FIGS. 1, 5, 7, 8 and 10. For example, in FIGS. 1 and 5 just the head 23 of socket extension bar 21 is substantially exposed outside of the hollow portion 11 of handle 5 while socket extension bar 21 is substantially housed and secured within the hollow portion 11 of wrench handle 5.

When considering various preferred embodiments of the present invention that combine a socket bar extension with a wrench, the predetermined configuration of the cavity 29 in the head 23 of socket extension bar 21, and, the predetermined configuration of the driving member 7 of the ratchet wrench head 3 are each preferably formed to interlock with the other, whereby, the ratchet wrench may control rotation of the socket extension bar. In other words, driving member 7 of wrench head 3 shown in FIG. 1 is configured to fit inside of and interlock with the cavity 29 in the head 23 of socket bar extension 21 so that ratchet wrench 1 can control rotation of socket extension bar 21. Such an arrangement is preferred but not required.

When considering various preferred embodiments of the present invention that combine a socket extension bar with a wrench, the socket extension bar is preferably formed with a predetermined interlocking means, and, the wrench handle is preferably formed with a predetermined interlocking means, whereby, the interlocking means of the socket extension bar can interlock with the interlocking means of the wrench handle to detachably secure the socket extension bar within the hollow portion of the wrench handle. For example, as shown in FIG. 5, socket extension bar 21 has a spring-loaded ball 31 protruding from the driving end 25 thereof. And, as shown in FIG. 6, hollow portion 11 of wrench handle 5 has a substantially square shaped opening 35 when the hollow portion 11 of wrench handle 5 is viewed from a rear end-view thereof. Square shaped opening 35 has four walls (such as wall 37) extending in the direction of which the wrench handle 5 is elongated. If, at least one of the four walls such as wall 37 surrounding the square shaped opening 35 at the front part 13 of hollow portion 11 of wrench handle 5 is notched such as with notch 33 (seen in FIG. 5) to receive the spring-load ball 31 of socket extension bar 21, then, socket extension bar 21 is effectively and efficiently detachably secured within the hollow portion 11 of wrench handle 5. A user would simply insert the socket extension bar 21 into the open distal end 17 of hollow portion 11 of wrench handle 5 to frictionally lodge spring-loaded-ball 31 into notch 33 to detachably secure socket extension bar 21 within wrench handle 5 which is seen best in FIG. 5.

Figure 7:
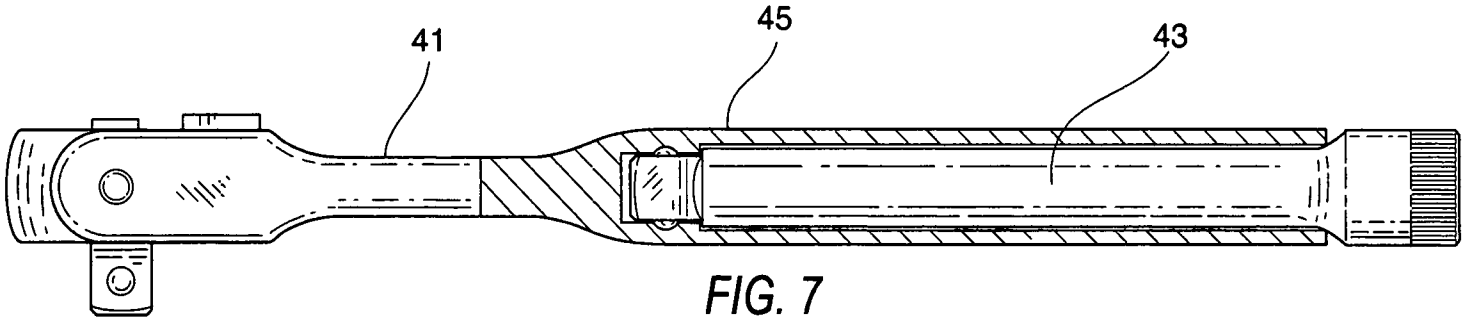
FIG. 7 shows a left side elevation view of another present invention wrench and socket extension bar, with the handle cut away in a cross-sectional view to better show the socket extension bar substantially housed and secured within the handle of a swivel-head ratcheting wrench.

FIG. 7 shows a left side elevation view of another present invention swivel-head ratcheting wrench 41 and socket extension bar 43, with the handle 45 cut away in a cross-sectional view to better show the socket extension bar 43 substantially housed and secured within the handle of a swivel-head ratcheting wrench 41. Socket extension bar 43 is substantially housed and secured within wrench handle 45 in the same way that socket extension bar 21 is housed and secured within handle 5 of wrench 1 shown and fully described in FIGS. 1-6 herein. However, the socket extension bar 43 in this FIG. 7 is much longer relative to the length of wrench 41 than the socket extension bar 21 is to wrench 1 shown and described in FIGS. 1-6. Accordingly, the socket extension bar component of a present invention embodiment may be of any practical length (short, medium or long) relative to the length of the wrench and wrench handle, provided that the socket extension bar can be substantially housed and detachably secured within the hollow portion of the wrench handle. It's possible to have multiple socket extension bars substantially housed and detachably secured within a present invention wrench handle if the hollow portion of the handle is configured to accommodate multiple socket extension bars.

Figure 8:
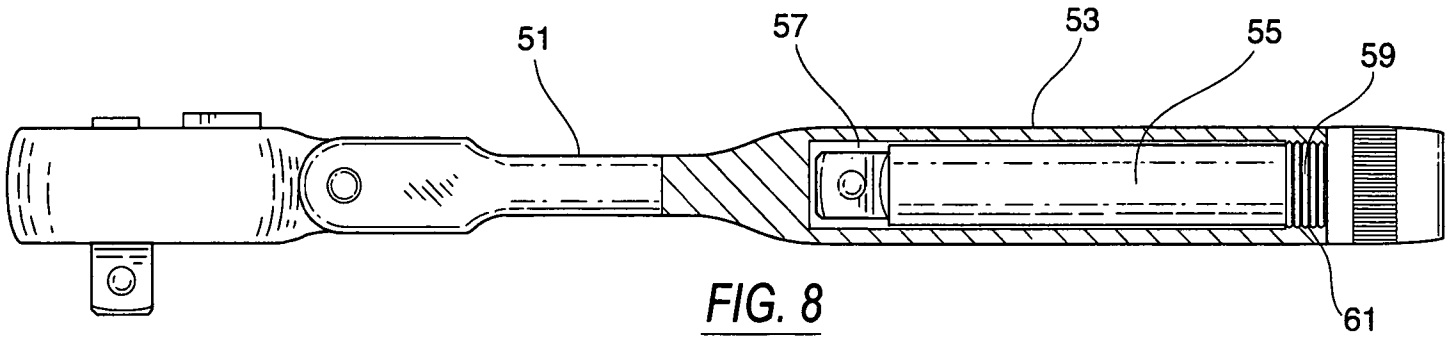
FIG. 8 shows a left side elevation view of another present invention wrench and socket extension bar, with the handle cut away in a cross-sectional view to better show the socket extension bar substantially housed and secured within the handle of a flex-head ratcheting wrench.
Figure 9:
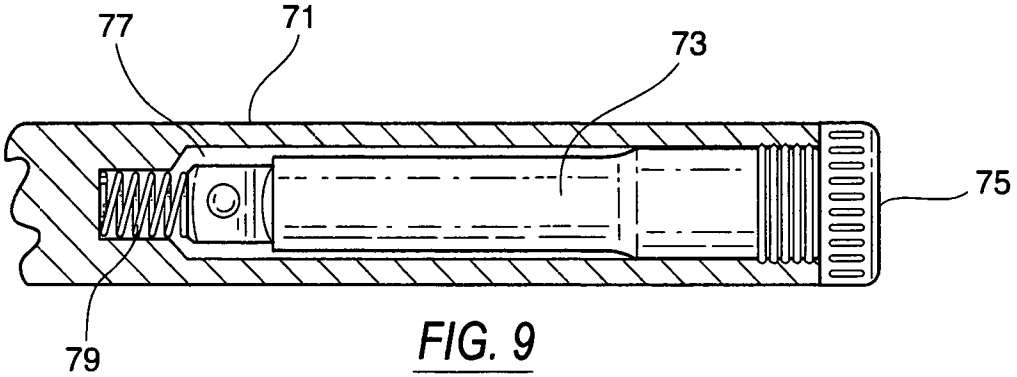
FIG. 9 shows a left side elevation cut cross-sectional view of another present invention wrench handle showing a socket extension bar substantially housed and secured therein.

FIG. 8 shows a left side elevation view of another present invention flex-head ratcheting wrench 51 and socket extension bar 55, with the wrench handle 53 cut away in a cross-sectional view to better show the socket extension bar 55 substantially housed and secured within the handle 53. As described previously herein, when considering various preferred embodiments of the present invention that combine a socket extension bar with a wrench, the socket extension bar is preferably formed with a predetermined interlocking means, and, the wrench handle is preferably formed with a predetermined interlocking means, whereby, the interlocking means of the socket extension bar can interlock with the interlocking means of the wrench handle. In this FIG. 8, socket extension bar 55 has threads 59 that are formed to cooperate and interlock with the threads 61 of handle 53 so that a user can insert and screw socket extension bar 55 into the hollow portion 57 of handle 53 to substantially house and detachably secure socket extension bar 55 within wrench handle 53. To access the socket extension bar 55 for use, a user would simply unscrew the socket extension bar 55 out of the hollow portion 57 of handle 53.

As described previously herein, the present invention includes preferred embodiments wherein at least a small portion of the socket extension bar is exposed outside of the hollow portion of the wrench handle while the socket extension bar is substantially housed and detachably secured therein. This structural arrangement facilitates insertion and removal of the socket extension bar into and out of the hollow portion of the wrench handle by a user as shown and described here in FIG. 8.

FIG. 9 shows a left side elevation cut cross-sectional view of another present invention wrench handle 71 showing a socket extension bar 73 substantially housed and secured therein. In this example embodiment of the present invention, wrench handle 71 has a removable threaded cap 75 at the rear part of the hollow portion 77 of wrench handle 71 to detachably secure socket extension bar 73 within handle 71. A spring 79 is added at the front part of the hollow portion of the handle to assist a user with the removal and insertion of socket extension bar 73 from and into the hollow portion 77 of handle 71.

Figure 10:
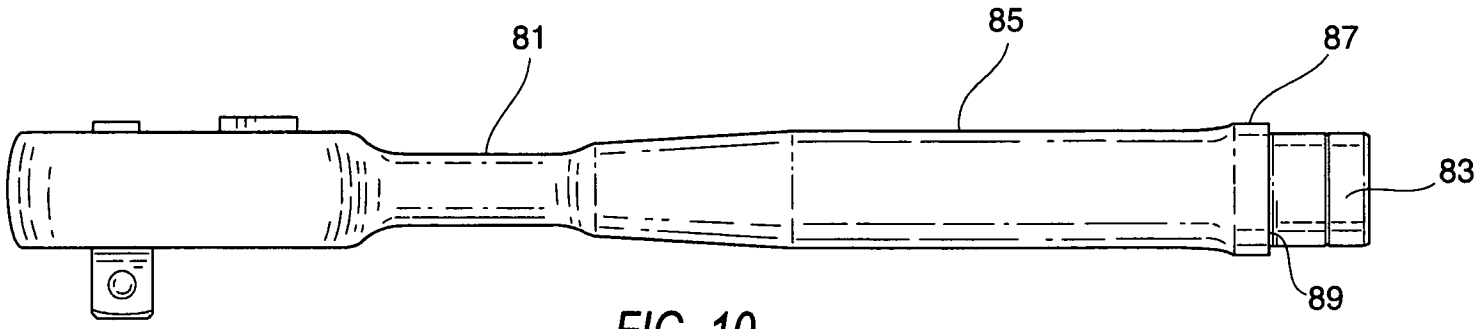
FIG. 10 shows a left side elevation view of another present invention ratchet wrench and socket extension bar.

FIG. 10 shows a left side elevation view of another present invention ratchet wrench and socket extension bar. This ratchet wrench and socket extension bar are similar to the ratchet wrench and socket extension bar shown in FIGS. 1-6, however, in this FIG. 10 ratchet wrench 81 has a handle 85 that has a raised area 87 formed around the handle and close to the rear distal open end 89 to preclude an accidental pull-out of socket extension bar 83 from handle 85 during high torque applications to handle 85 by a user.

Upon reading and understanding the specification of the present invention described above, modifications and alterations will become apparent to those skilled in the art. It is intended that all such modifications and alterations be included insofar as they come within the scope of the patent as claimed or the equivalence thereof.

What is claimed is:

1. A wrench handle being elongated in a predetermined direction and having at least a portion thereof being substantially hollow, said hollow portion having a front part and a rear part, the front part of said hollow portion being formed having a substantially square shaped opening being surrounded by four walls extending in the direction of which said handle is elongated, said square shaped opening further being formed to receive a driving member of a socket extension bar having a similar square shape when viewed from an end-view thereof, the rear part of the hollow portion of said handle having a distal open end, whereby, the socket extension bar may be inserted into the rear part of said hollow portion of said handle with the driving member of said socket extension bar entering into the square shaped opening at the front part of the hollow portion of said wrench handle, whereby, said socket extension bar may be substantially housed and detachably secured within the hollow portion of said wrench handle.

2. The wrench handle of claim 1 wherein the socket extension bar has a spring-loaded ball protruding from the driving member thereof, and at least one of the four walls surrounding the square shaped opening at the front part of the hollow portion of said wrench handle is notched to receive the spring-loaded ball of the driving member of said socket extension bar to detachably secure the socket extension bar within the hollow portion of said wrench handle.

3. The wrench handle of claim 2 wherein the hollow portion of said wrench handle has a predetermined length; and, the socket extension bar has a predetermined length, and, at least a small portion of the socket extension bar is exposed outside of the hollow portion of said wrench handle while said socket extension bar is substantially housed and detachably secured therein to facilitate insertion and removal of said socket extension bar into and out of the hollow portion of said wrench handle by a user.

4. The wrench handle of claim 2 wherein each of all four walls surrounding the square shaped opening at the front part of the hollow portion of said wrench handle is notched to receive the spring-loaded ball of the driving member of said socket extension bar to detachably secure the socket extension bar within the hollow portion of said wrench handle.

5. The wrench handle of claim 1 wherein the hollow portion of said wrench handle has a predetermined length; and, the socket extension bar has a predetermined length, and, a small portion of the socket extension bar is exposed outside of the hollow portion of said wrench handle while said socket extension bar is substantially housed and detachably secured therein to facilitate insertion and removal of said socket extension bar into and out of the hollow portion of said wrench handle by a user.

6. A wrench comprising a wrench head and handle;

said wrench head comprising a driving member formed having a predetermined configuration; and, said wrench handle being elongated in a predetermined direction and having at least a portion thereof being substantially hollow, said hollow portion having a front part and a rear part, the front part of said hollow portion being formed having a substantially square shaped opening being surrounded by four walls extending in the direction of which said handle is elongated, said square shaped opening further being formed to receive a driving member of a socket extension bar having a similar square shape when viewed from an end-view thereof, the rear part of the hollow portion of said handle having a distal open end, whereby, the socket extension bar may be inserted into the rear part of said hollow portion of said handle with the driving member of said socket extension bar entering into the square shaped opening at the front part of the hollow portion of said wrench handle, whereby, said socket extension bar may be substantially housed and detachably secured within the hollow portion of said wrench handle.

7. The wrench of claim 6 wherein the socket extension bar has a spring-loaded ball protruding from the driving member thereof, and at least one of the four walls surrounding the square shaped opening at the front part of the hollow portion of said wrench handle is notched to receive the spring-loaded ball of the driving member of said socket extension bar to detachably secure the socket extension bar within the hollow portion of said wrench handle.

8. The wrench of claim 7 wherein the hollow portion of said wrench handle has a predetermined length; and, the socket extension bar has a predetermined length, and, at least a small portion of the socket extension bar is exposed outside of the hollow portion of said wrench handle while said socket extension bar is substantially housed and detachably secured therein to facilitate insertion and removal of said socket extension bar into and out of the hollow portion of said wrench handle by a user.

9. The wrench of claim 7 wherein each of all four walls surrounding the square shaped opening at the front part of the hollow portion of said wrench handle is notched to receive the spring-loaded ball of the driving member of said socket extension bar to detachably secure the socket extension bar within the hollow portion of said wrench handle.

10. The wrench of claim 6 wherein the hollow portion of said wrench handle has a predetermined length; and, the socket extension bar has a predetermined length, and, at least a small portion of the socket extension bar is exposed outside of the hollow portion of said wrench handle while said socket extension bar is substantially housed and detachably secured therein to facilitate insertion and removal of said socket extension bar into and out of the hollow portion of said wrench handle by a user.

11. The wrench of claim 6 wherein the driving member of the wrench head is similar in size and configuration to the driving member of said socket extension bar.

12. A combination of a socket extension bar and a ratchet wrench, said combination comprising:

said socket extension bar being elongated having two ends with a head at one end and a driving member at the other end thereof, the head having a cavity formed therein with a predetermined configuration, the driving member being formed with a predetermined configuration, said socket extension bar further having predetermined length and width dimensions; and, said ratchet wrench having a wrench head and handle; said wrench head comprising a ratcheting mechanism and a driving member formed with a predetermined configuration; said wrench handle being elongated in a predetermined direction and having at least a portion thereof being substantially hollow, said hollow portion having a front part and a rear part, the front part of said hollow portion being formed having a substantially square shaped opening surrounded by four walls extending in the direction of which said handle is elongated, said square shaped opening further being formed to receive the driving member of said socket extension bar, the rear part of the hollow portion of said handle having a distal open end, whereby, the socket extension bar may be inserted into the rear part of the hollow portion of said handle with the driving member of said socket extension bar entering into the square shaped opening at the front part of the hollow portion of said wrench handle, whereby, said socket extension bar may be substantially housed and detachably secured within the hollow portion of said wrench handle.

13. The combination of a socket extension bar and a ratchet wrench of claim 12 wherein the predetermined configuration of the cavity in the head of the socket extension bar and the predetermined configuration of the driving member of said ratchet wrench head are each formed to interlock with the other, whereby, the ratchet wrench may control rotation of the socket extension bar.

14. The combination of a socket extension bar and ratchet wrench of claim 12 wherein at least a small portion of the socket extension bar is exposed outside of the hollow portion of said wrench handle while said socket extension bar is substantially housed and detachably secured therein to facilitate insertion and removal of said socket extension bar into and out of the hollow portion of said wrench handle by a user.

15. The combination of a socket extension bar and a ratchet wrench of claim 14 wherein the entire head of the socket extension bar is substantially exposed outside of the hollow portion of the ratchet wrench handle when said socket extension bar is housed and secured within the hollow portion of said wrench handle.

16. The combination of a socket extension bar and a ratchet wrench of claim 12 wherein the socket extension bar has a spring-loaded ball protruding from the driving member thereof, and at least one of the four walls surrounding the square shaped opening at the front part of the hollow portion of said wrench handle is notched to receive the spring-loaded ball of the driving member of said socket extension bar to detachably secure the socket extension bar within the hollow portion of said wrench handle.

17. The combination of a socket extension bar and a ratchet wrench of claim 16 wherein each of all four walls surrounding the square shaped opening at the front part of the hollow portion of said wrench handle is notched to receive the spring-loaded ball of the driving member of said socket extension bar to detachably secure the socket extension bar within the hollow portion of said wrench handle.

18. The combination of a socket extension bar and a ratchet wrench of claim 12 wherein the driving member of the wrench head is similar in size and configuration to the driving member of said socket extension bar.

* * * * *